US006937165B2

(12) United States Patent
Rogers

(10) Patent No.: US 6,937,165 B2
(45) Date of Patent: Aug. 30, 2005

(54) VIRTUAL RUMBLE STRIP

(75) Inventor: William H. Rogers, Eden Prairie, MN (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 10/252,269

(22) Filed: Sep. 23, 2002

(65) Prior Publication Data

US 2004/0056762 A1 Mar. 25, 2004

(51) Int. Cl.[7] ..... G08G 5/04; G08B 23/00

(52) U.S. Cl. ..... 340/963; 340/961; 342/455; 701/301

(58) Field of Search ..... 340/961, 963–965, 340/435; 701/213, 301; 342/455; 381/17

(56) References Cited

U.S. PATENT DOCUMENTS

| | | | | | |
|---|---|---|---|---|---|
| 4,317,119 | A | * | 2/1982 | Alvarez | 342/455 |
| 5,106,226 | A | | 4/1992 | Fanslow et al. | 404/15 |
| 5,291,414 | A | * | 3/1994 | Tamai et al. | 701/210 |
| 5,574,641 | A | * | 11/1996 | Kawakami et al. | 701/1 |
| 5,710,559 | A | * | 1/1998 | Krogmann | 340/963 |
| 5,765,116 | A | * | 6/1998 | Wilson-Jones et al. | 701/41 |
| 5,872,526 | A | * | 2/1999 | Tognazzini | 340/961 |
| 5,890,083 | A | | 3/1999 | Franke et al. | 701/45 |
| 5,979,586 | A | * | 11/1999 | Farmer et al. | 180/274 |
| 6,014,595 | A | * | 1/2000 | Kobayashi | 701/45 |
| 6,021,374 | A | * | 2/2000 | Wood | 701/301 |
| 6,038,496 | A | | 3/2000 | Dobler et al. | 701/3 |
| 6,085,151 | A | * | 7/2000 | Farmer et al. | 701/301 |
| 6,111,526 | A | | 8/2000 | Aymeric et al. | 340/972 |
| 6,118,875 | A | * | 9/2000 | M.o slashed.ller et al. | 381/1 |
| 6,178,379 | B1 | * | 1/2001 | Dwyer | 701/205 |
| 6,259,374 | B1 | | 7/2001 | Kisner et al. | 340/905 |
| 6,317,690 | B1 | * | 11/2001 | Gia | 701/301 |
| 6,389,332 | B1 | * | 5/2002 | Hess et al. | 701/1 |

(Continued)

FOREIGN PATENT DOCUMENTS

| | | | |
|---|---|---|---|
| EP | 1 104 881 | 6/2001 | G01D/1/00 |
| GB | 2 232 518 | 12/1990 | G08G/1/16 |
| JP | 08 258797 | 10/1996 | B64D/45/00 |
| JP | 10 103966 | 4/1998 | G01C/21/00 |
| JP | 11 232591 | 8/1999 | G08G/1/09 |
| JP | 11 232593 | 8/1999 | G08G/1/09 |

OTHER PUBLICATIONS

D. J. Wheatley, et al., "The Use of a Multi–Modal Interface to Integrate In–Vehicle Information Presentation," David J. Wheatley & Joshua B. Hurwitz User Centered Research, Motorola Labs, http://health.public–policy–center. uiowa. edu/driving–assessment/Summaries/Driving%20Assessment%20Papers/16_Wheatley_David.htm.

(Continued)

*Primary Examiner*—Jeffery Hofsass
*Assistant Examiner*—Anne V. Lai
(74) *Attorney, Agent, or Firm*—McDonnell Boehnen Hulbert & Berghoff LLP

(57) ABSTRACT

A system and method are provided for a virtual rumble strip that uses a 3-dimensional audio alert (3-DAA) signal to warn a user operating a vehicle that the vehicle has deviated from a predetermined path. The virtual rumble strip may include a sensor that detects location data for the vehicle, and an alerting mechanism that receives the location data from the sensor. The alerting mechanism may include an audio processing unit that uses the location data and a Head-Related Transfer Function to create the 3-DAA signal. A speaker may then play the 3-DAA signal, which the user may interpret as originating from the direction of the deviation. The user may then respond to the 3-DAA signal by correcting the motion of the vehicle.

27 Claims, 7 Drawing Sheets

U.S. PATENT DOCUMENTS

| | | | | | |
|---|---|---|---|---|---|
| 6,405,132 | B1 | * | 6/2002 | Breed et al. | 701/301 |
| 6,420,997 | B1 | * | 7/2002 | Cong | 342/70 |
| 2002/0005778 | A1 | | 1/2002 | Breed et al. | 340/435 |
| 2002/0019697 | A1 | | 2/2002 | Cong et al. | 701/207 |
| 2002/0044081 | A1 | | 4/2002 | Cong | 342/70 |
| 2002/0147586 | A1 | * | 10/2002 | Belrose | 704/233 |
| 2002/0184236 | A1 | * | 12/2002 | Donath et al. | 707/104.1 |
| 2003/0023614 | A1 | * | 1/2003 | Newstrom et al. | 707/104.1 |

OTHER PUBLICATIONS

D. Stauffer et al., "An Electronic Rumble Strip," Honeywell Technology Center, SPIE vo. 2902, pp. 106–112.

Dr. Craig Sjankwitz, "Intelligent Transportation Systems Institute," Intelligent Vehicles Laboratory, University of Minnesota Twin Cities, http://www.its.umn.edu/publications/factsheets/fs010.pdf.

Dr. Heinrich Bantli, 3M Commercializes Lane Awareness System for Worldwide Market http://ivsource.net/archivep/2000/jun/a000630_3mlaneaware.pdf.

G. A. Williamson, "Automotive Lane Tracker," pp. 1–5, http://www.williamson–labs.com/lane.htm.

G.A. Williamson, "Lane Tracker Architecture," pp. 1–11, http://www.williamson–labs.com/x–cam.htm.

J. G. Smith et al., "The Look Ahead," Heavy Duty Truck Spec'ing Guide, http://www.trucknews.com/truckspec/features/outlookequipment.htm.

J. L. Broge, "Heavy–duty truck safety Systems," Automotive Engineering International Online: http://www.sae.org/automag/techbriefs_05–00/04.htm.

Stuttggart, "The Thinking Vehicle–How Assistance Systems Support Drivers," http://www.daimlerchrysler.com/news/top/2000/t01113_3.htm.

Wenzel, Elizabeth M., "Localization in Virtual Acoustic Displays," Presence: vol. 1, No. 1, pp. 80–107.

"Advanced Truck Systems—AFS," Vehicle Systems Technology Center, http://www.rtna.daimlerchrysler.com/VSTC/frames/projects/ats/lane_guid_e.html.

"Intelligent Vehicle Initiative," http://www.dot.state.mn.us/guidestar/pdf/ivifacts.pdf.

* cited by examiner

VIRTUAL RUMBLE STRIP

FIELD OF THE INVENTION

The present invention relates to the field of warning systems for users operating vehicles. More specifically, this invention relates to the use of a spatial audio alert signal in a virtual rumble strip for warning a user that their vehicle has deviated from a predetermined path.

BACKGROUND

Modern transportation systems have revolutionized society by enabling people to travel to and from almost any location in the world. People today often travel for business or pleasure by land, sea, and air. Additionally, businesses rely on transportation systems for the efficient transfer of goods and services throughout the world. Other organizations, such as militaries, also depend on vehicles such as aircraft, naval vessels, and trucks for transporting men and supplies.

As our society continues to become more mobile, it has become increasingly important to find safer and more effective ways of transporting people. Unfortunately, accidents still pose a major threat to the welfare of travelers. To illustrate, the National Center for Statistics and Analysis (NCSA) estimates that approximately 41,000 people were killed due to automobile accidents in the United States during 2001. Furthermore, aircraft and boating accidents also occur every year, resulting in significant loss of life.

Many accidents involving vehicles may be preventable if a user operating the vehicle is properly warned of an impending danger. For example, many automobile accidents occur when drivers accidentally allow their vehicle to veer off the road. This may happen, for example, if a driver falls asleep or otherwise loses consciousness while driving. Additionally, a number of aircraft crashes may occur when a pilot accidentally veers from a desired flight path, such as when visibility is poor during inclement weather.

Presently, rumble strips are often used to alert automobile drivers that their vehicles are drifting off a road. Such rumble strips may be a series of grooves in the road that cause an automobile to vibrate and its tires to emit a "rumbling" sound as they pass over the strip. This vibration and sound alert the driver that the vehicle has deviated from the road, and the driver may then correct the motion of the vehicle.

Although existing rumble strips and other user alert systems reduce the risk of an accident, they may also include a number of disadvantages. First, existing real rumble strips are limited to use on land, and therefore, cannot be used with aircraft or ships. Additionally, such rumble strips may not accurately provide a user with the direction that a vehicle has deviated from a path. Thus, a user may have to determine the direction of the deviation after hearing the rumbling sound or feeling the vibration caused by the rumble strip. In a potential crash situation, the extra fraction of a second that it takes a user to determine the direction of the deviation may be the difference between life and death.

Accordingly, it is desirable to have a system and method for alerting a user operating a vehicle of an impending danger that overcomes the above deficiencies associated with the prior art. This may be achieved by using virtual rumble strips with spatial audio alert signals.

DETAILED DESCRIPTION

I. Exemplary Virtual Rumble Strip

In an exemplary embodiment, a virtual rumble strip may use a spatial audio alert signal, such as a 3-dimensional audio alert (3-DAA) signal, to warn a user that their vehicle has deviated from a predetermined path. When a vehicle crosses into a region near the edge of the predetermined path (e.g., a shoulder of a road), the virtual rumble strip may emit a 3-DAA signal that indicates to the user the direction of the vehicle's deviation. To illustrate, in an exemplary scenario, a car may drift onto the left shoulder of a road. The virtual rumble strip may use sensors for detecting the car's movement, and determine that the car is in danger of leaving the road. The virtual rumble strip may then generate a 3-DAA signal that appears to originate from the direction of the deviation (i.e., the left shoulder of the road). The virtual rumble strip may then play the 3-DAA signal for the driver, who may then use the data provided by the signal to correct the car's motion.

In addition, the exemplary embodiments for the virtual rumble strip presented here may include a number of advantages. For example, the present virtual rumble strip may warn a user who has fallen asleep or lost alertness while operating a vehicle of a potential deviation in the vehicle's movement. In addition, such a virtual rumble strip may help a user navigate a vehicle along a predetermined path when inclement weather or other exterior conditions hinder visibility. Furthermore, the exemplary virtual rumble strip is not limited to use on land and may be used for any type of vehicle traveling on any type of medium (e.g., land, air, water). Additionally, the present virtual rumble strip may enable a user to respond more quickly when the vehicle deviates from a predetermined path by providing the direction of the deviation within a 3-DAA signal, thus reducing the chance of an accident.

II. Exemplary Vehicles for Use with a Virtual Rumble Strip

A. Exemplary Automobile

Figure 1A:
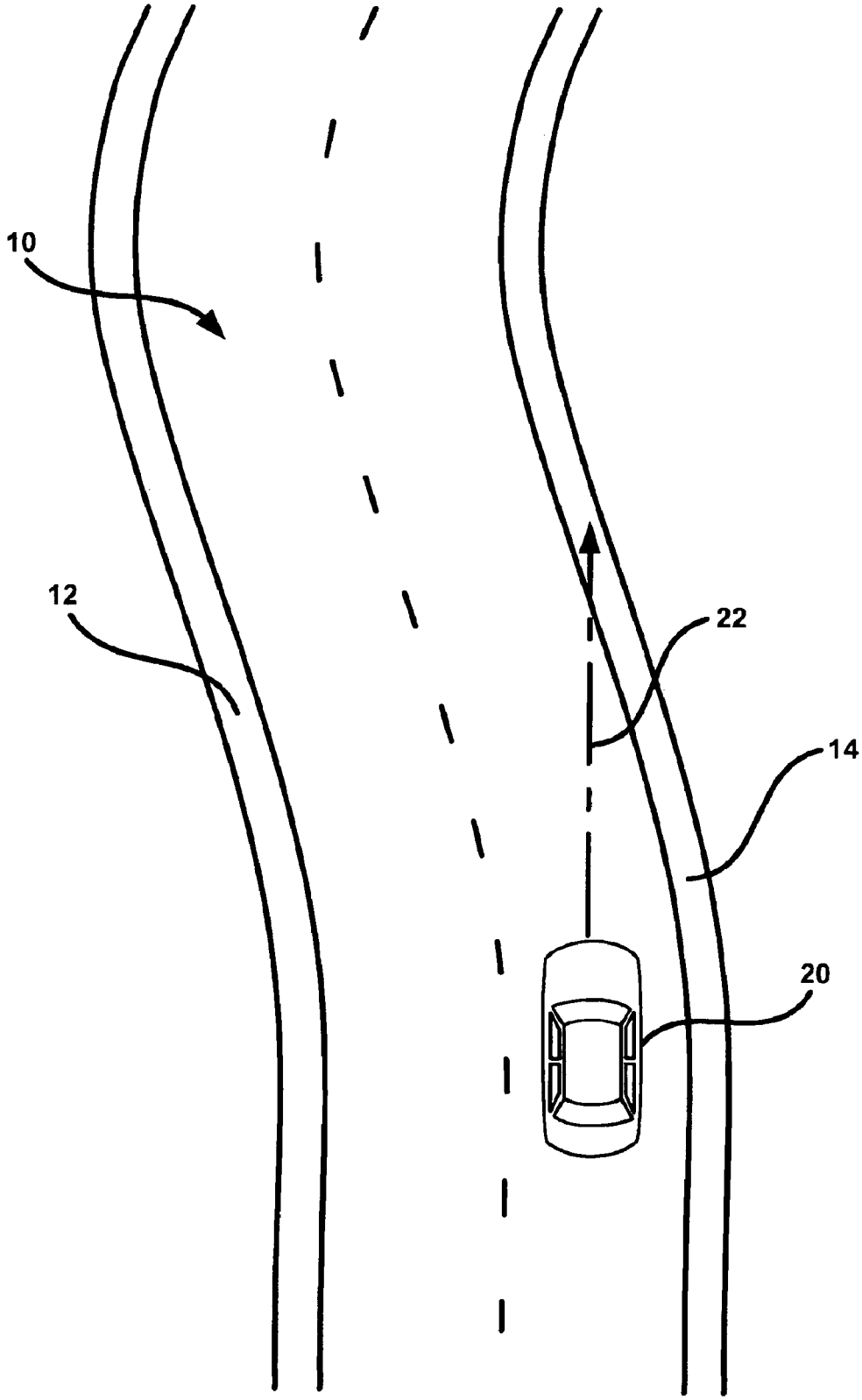
FIGS. 1*a–b* illustrate exemplary embodiments of an automobile traveling along a road.

Turning now to the drawings, FIG. 1*a* shows an exemplary embodiment of an automobile 20 traveling on a curved road 10 having left and right shoulders 12, 14. If the automobile 20 hits one of the shoulders 12, 14, a warning system, such as a virtual rumble strip, may use a 3-DAA signal to indicate to the driver the direction that the vehicle has deviated from the road 10. In the present embodiment, the automobile 20 will impact the right shoulder 14 if it continues to travel in a straight line as indicated by the automobile's projected future path 22. Thus, when the automobile 20 hits the right shoulder 14, the virtual rumble strip may emit a 3-DAA signal that the driver interprets as coming from the direction of the front/right region of the automobile 20 (i.e., the direction of the deviation). By providing the direction of the deviation in the 3-DAA signal, the driver may respond more quickly to the signal in order to correct the movement of the automobile 20.

Figure 1B:
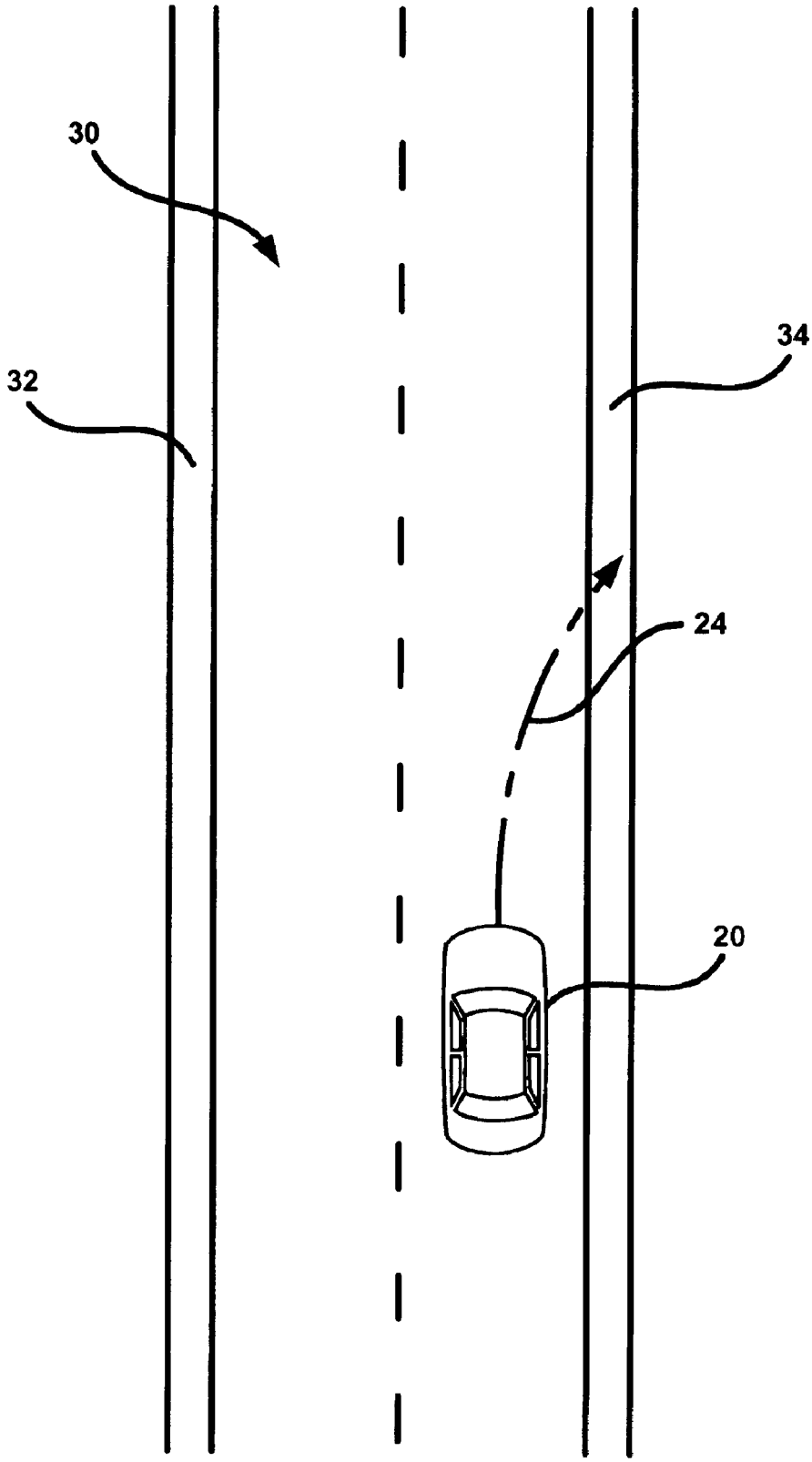

In FIG. 1*b*, the automobile 20 is shown traveling along an exemplary straight road 30 having left and right shoulders 32, 34. In the present embodiment, the automobile 20 will impact the right shoulder 34 if it curves to the right as indicated by the automobile's projected future path 24. Similar to the previous embodiment, when the automobile 20 hits the right shoulder 34, the virtual rumble strip may emit a 3-DAA signal that the driver interprets as coming from the direction of the deviation (e.g., front/right region of the automobile 20), and the driver may respond to the signal in order to correct the motion of the automobile 20.

B. Exemplary Airplane

Figure 2A:
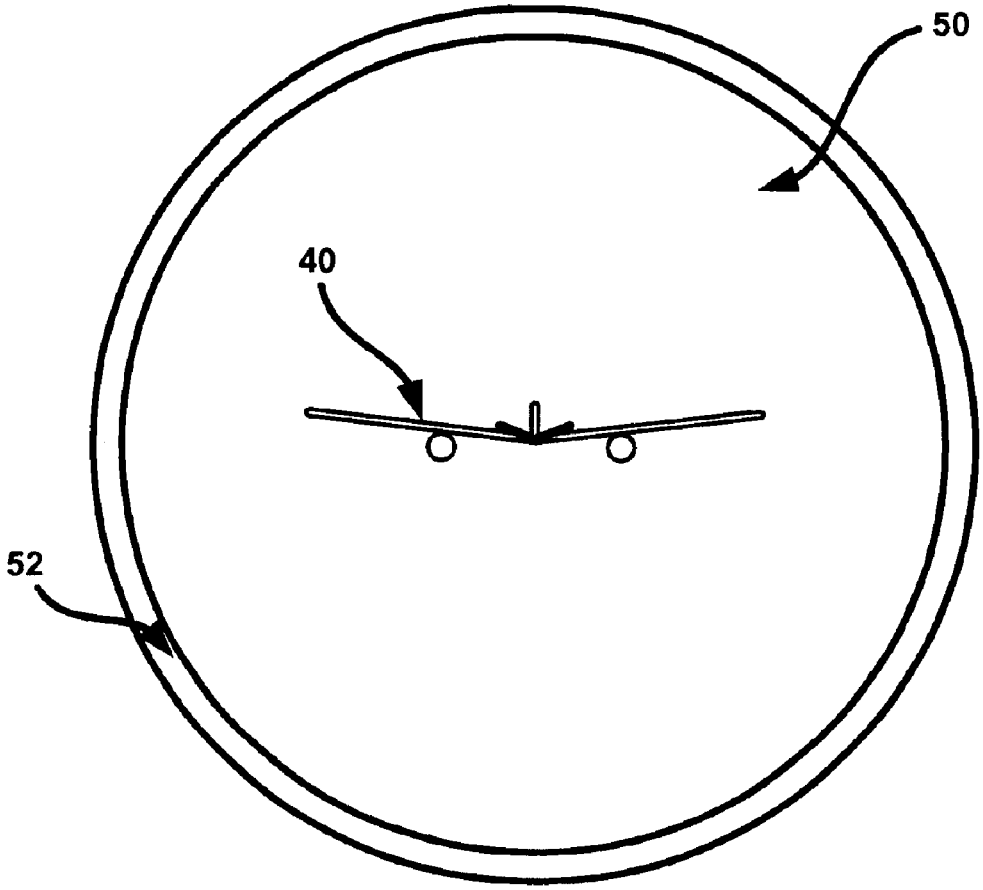
FIGS. 2*a–c* illustrate exemplary embodiments of an airplane traveling along a virtual tunnel.

Turning now to FIG. 2*a*, an exemplary embodiment is shown for an airplane 40 traveling along a virtual tunnel 50 having an edge region 52. The airplane 40 or an entity such as an air traffic controller may define the virtual tunnel 50 and edge region 52 at any time before or during the flight. In the present embodiment, the virtual tunnel 50 may be a predetermined flight path through which the airplane 40 may fly, and the edge region 52 may be a boundary through which the airplane 40 should not fly. Thus, if the airplane 40 passes through the edge region 52, a virtual rumble strip may emit a 3-DAA signal to indicate that the airplane 40 is deviating from the tunnel 50.

Figure 2B:
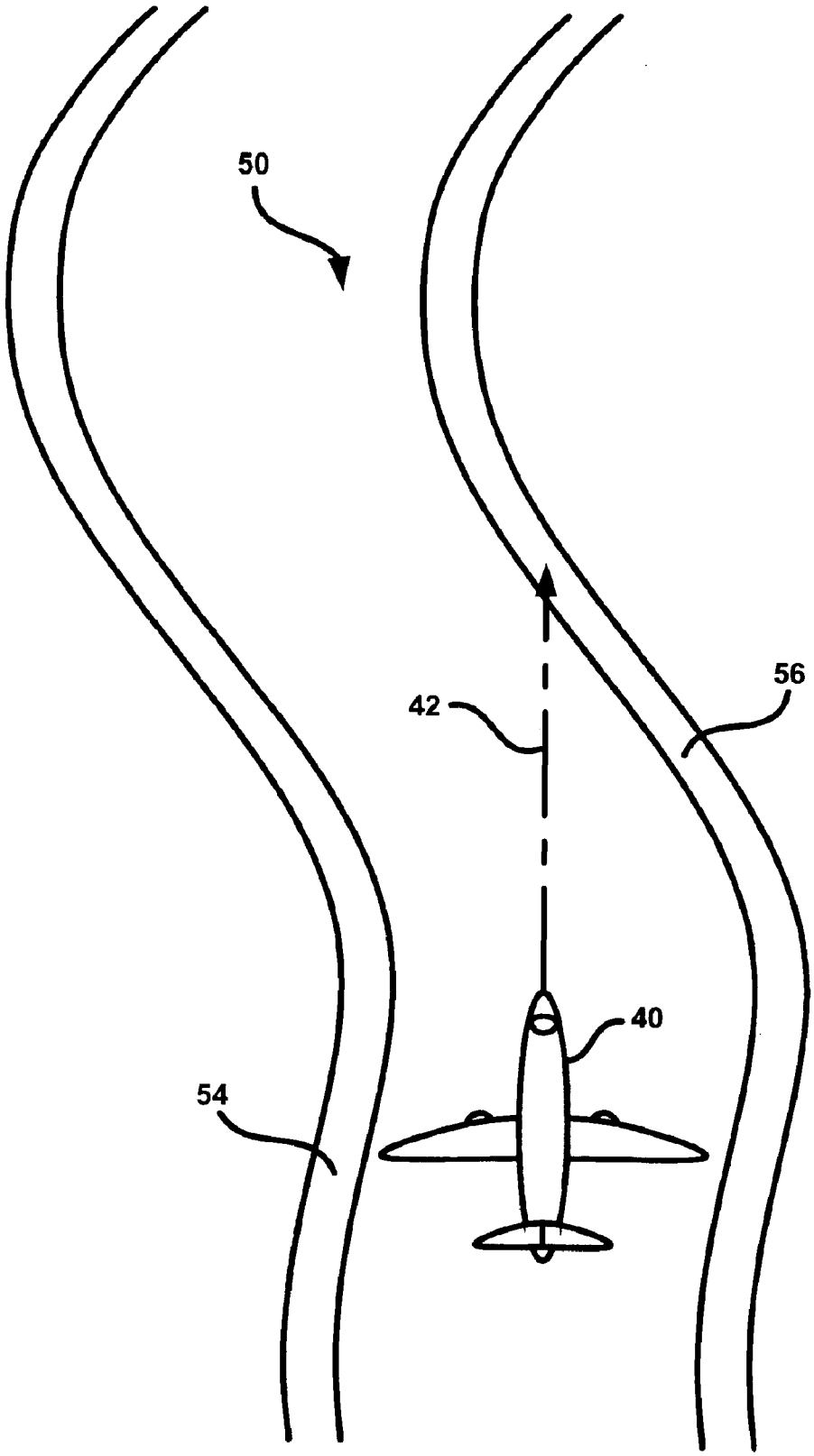

FIG. 2*b* shows an exemplary top view of the virtual tunnel 50 with curved left and right shoulders 54, 56. The left and right shoulders 54, 56 are simply planar slices of the edge region 52 of FIG. 2*a*. In the present embodiment, the airplane 40 will impact the right shoulder 56 if it continues to travel in a straight line as indicated by the airplane's projected future path 42. Thus, when the airplane 40 hits the right shoulder 56, the virtual rumble strip may emit a 3-DAA signal that the pilot interprets as coming from the front/right region of the airplane 40 (i.e., the direction of the deviation). By providing the direction of the deviation in the 3-DAA signal, the pilot may respond more quickly to the signal in order to correct the movement of the airplane 40.

Figure 2C:
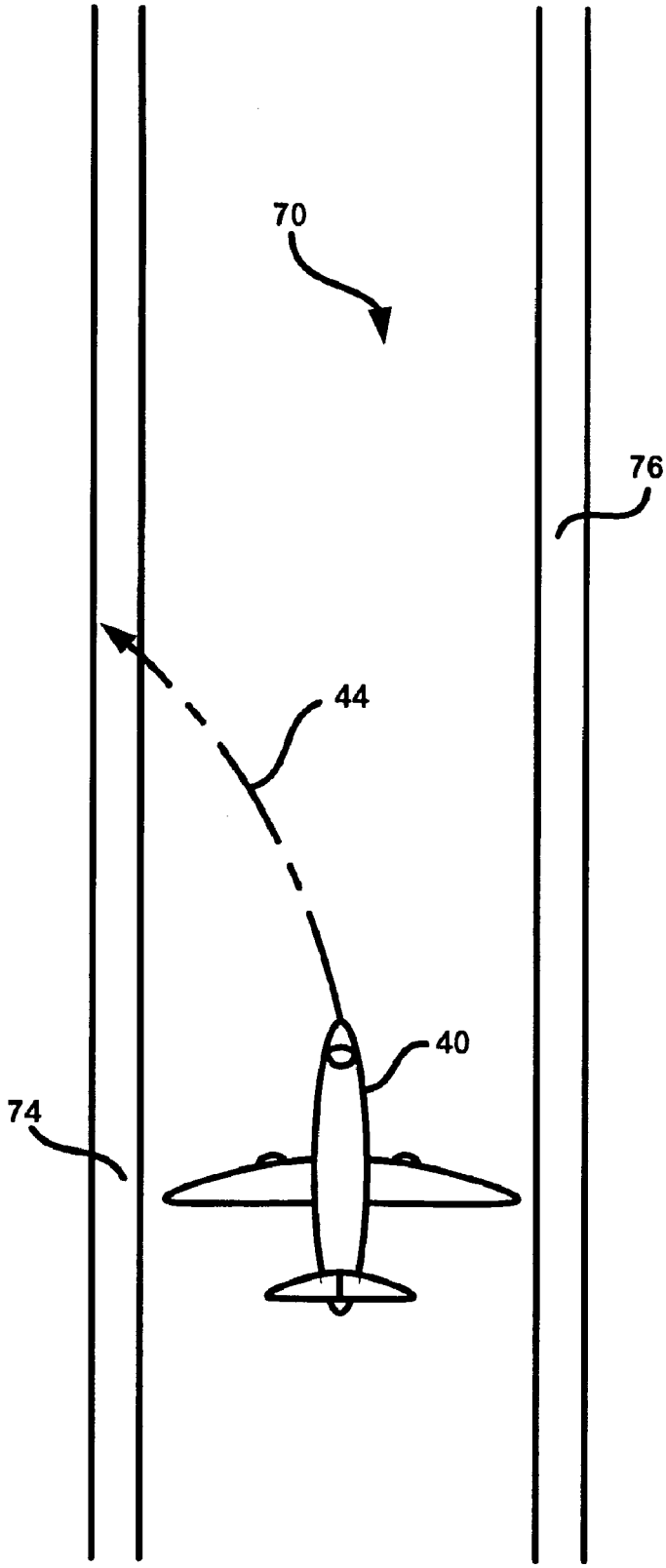

FIG. 2*c* shows an exemplary top view of a different portion of the virtual tunnel 50 with straight left and right shoulders 74, 76, which are once again planar slices of the edge region 52 of FIG. 2*a*. In the present embodiment, the airplane 40 will impact the left shoulder 74 if it curves to the left as indicated by the airplane's projected future path 44. Similar to the previous embodiments, the virtual rumble strip may emit a 3-DAA signal that the pilot interprets as coming from the direction of the deviation (e.g., front/left region of the airplane 40), and the pilot may respond to the signal in order to correct the motion of the airplane 40.

It should be noted that any number of alternate embodiments may be contemplated for use in the present scenarios. For example, although the automobile 20 and airplane 40 are shown in FIGS. 1*a–b*, 2*a–c*, it should be understood that any type of vehicle (e.g., helicopter, submarine, boat, space shuttle, dirigible, hovercraft, bicycle, moving pedestrian, etc.) may alternatively be used with the present embodiments. In addition, in alternate embodiments, the virtual rumble strip may emit a 3-DAA signal before a vehicle hits a shoulder, such as when it is evident from the vehicle's projected future path that it will hit a shoulder if it continues in the direction it is traveling. Furthermore, a predetermined path (e.g., road, sidewalk, bike path, virtual tunnel, virtual waterway, etc.) may have any number of shoulders, and characteristics of the 3-DAA signal (e.g., frequency, pitch, duration, type of sound, etc.) may depend on the degree to which a vehicle penetrates a shoulder. For example, in an alternate embodiment, the virtual tunnel 50 may have an outer edge region (not shown) that is exterior to the edge region 52. In such an embodiment, the virtual rumble strip may emit a louder 3-DAA signal if the airplane enters the outer edge region as opposed to if the airplane 40 only passes through the edge region 52.

III. Exemplary Virtual Rumble Strip

Figure 3:
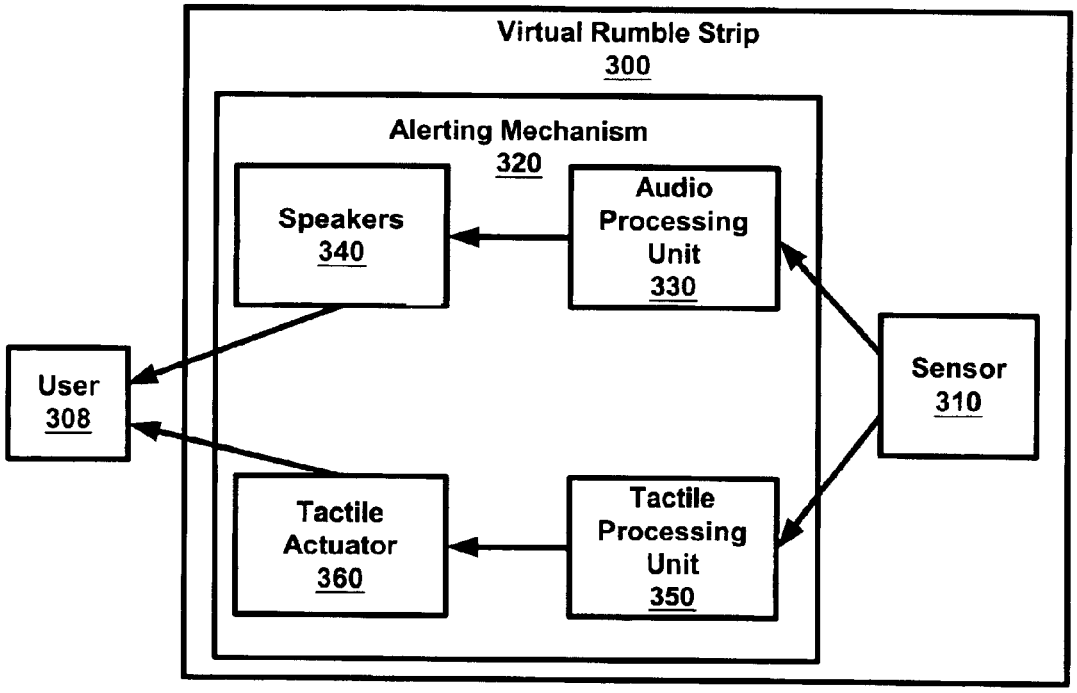
FIG. 3 is a block diagram illustrating an exemplary embodiment of a virtual rumble strip for users operating the vehicles of FIGS. 1*a*–2*c*.

Turning now to FIG. 3, an exemplary embodiment of a virtual rumble strip 300 is shown for use in a vehicle operated by a user 308. The exemplary virtual rumble strip 300 may warn the user 308 (e.g., driver, pilot) that the vehicle has deviated from a predetermined path (e.g., road, sidewalk, bike path, virtual tunnel, virtual waterway). In the present embodiment, the virtual rumble strip 300 may include an alerting mechanism 320 in communication with the user 308 and a sensor 310.

A. Exemplary Sensor

In the present embodiment, the sensor 310 may determine "location data" for the vehicle, which may include the position and movement (e.g., velocity and/or acceleration) of the vehicle relative to the predetermined path. The sensor 310 may use any type of sensing device for determining the location data, such as optical or electromagnetic sensors (e.g., infrared, visible light, microwave, radar), sonic sensors (e.g., sonar, ultrasonic), proximity sensors (e.g., capacitive, inductive) and physical contact sensors.

Alternatively, the sensor 310 may determine the location data by using a transmitter and/or a receiver for sending and receiving wireless signals with device(s) located on or near the predetermined path. The sensor 310 may use certain characteristics of these wireless signals (e.g., phase, frequency, amplitude, etc.) to determine the distance between the sensor 310 and the device(s). Since the sensor 310 is preferably attached to the vehicle, the sensor 310 may determine that the vehicle has deviated from the predetermined path when the distance between the sensor 310 and the device(s) changes to a certain level.

In yet another embodiment, location data may be determined using a location positioning system (e.g., Global Positioning System (GPS)) that tracks the position of the vehicle in relation to a store database of terrain and man made features that includes the predetermined path. The local positioning system may send the location data to the sensor 310, to the alerting mechanism 320, or directly to components within the alerting mechanism 320.

In the present embodiment, the exemplary sensor 310 may send the location data to the alerting mechanism 320 after the sensor 310 has determined that the vehicle has deviated from the predetermined path. Thus, the sensor 310 may also include a processor, such as a digital signal processor (DSP) (not shown), for interpreting the location data in order to determine whether the vehicle has deviated. Additionally, the sensor 310 or other component within the virtual rumble strip 300 may determine the location and direction of the deviation. Alternatively, the sensor 310 may continually send location data to the alerting mechanism 320, and the alerting mechanism 320 may be responsible for interpreting the location data. In yet another embodiment, the virtual rumble strip 300 may include an additional processor (not shown) that interprets the location data obtained by the sensor 310 in order to determine whether the vehicle has deviated.

B. Exemplary Audio Processing and Playback

In the present embodiment, the exemplary alerting mechanism 320 may include an audio processing unit 330 and speakers 340. The audio processing unit 330 may include a DSP and a memory unit (components not shown) that stores a Head-Related Impulse Function (HRIF) and/or a Head-Related Transfer Function (HRTF) for the user 308. As will be described shortly, the audio processing unit 330 may apply the HRTF to the location data received from the sensor 310 in order to create a 3-DAA signal. The speakers 340 (or other output device) may then play back the 3-DAA signal for the user 308 to hear.

The HRIF may be a function that describes how a person's ears acoustically modify sounds that they hear. Preferably, the HRIF is determined prior to the use of the virtual rumble strip 300. In an exemplary method of determining an HRIF, a speaker may produce a sound impulse at a specific location, and a miniature microphone may be placed in a user's ears to record how the ears acoustically modify the impulse. Once this acoustic modification is measured, it may be further processed (e.g., amplified and/or filtered) to form a customized HRIF for the user. The HRIF may then be converted to the HRTF via a Fourier transform. Alternatively, computer-implemented approximations of a Fourier transform may be used when creating an HRTF. In the present embodiment, the rumble strip 300 may include a customized HRTF for the user 308 (i.e., the HRIF was determined using the ears of the user 308). Alternatively, the rumble strip 300 may have an HRTF that has been generalized for multiple users (e.g., the HRIF was determined for an average individual or group of individuals).

The audio processing unit 330 may use the HRTF to determine the specific 3-DAA audio output signal to generate in order to simulate the sound emanating from a specific location. The 3-DAA signal may then be forwarded to speakers 340 for playback to the user 308. In the present embodiment, the speakers 340 may be a pair of headphones, but in alternate embodiments, the speakers may be any type of device that converts electrical signals into audible sound. Thus, the user 308 may hear the 3-DAA signal and interpret the sound as coming from the direction of the deviation (i.e., as specified by the location data). For more information on 3-dimensional audio signals, one can refer to Wenzel E. M., *Localization in Virtual Acoustic Displays*, Presence, vol. 1 number 1, (1992), pp. 80–107, the contents of which are incorporated in their entirety herein by reference.

C. Exemplary Tactile Processing and Actuation

In the present embodiment, the alert mechanism 320 may include a tactile processing unit 350 in communication with a tactile actuator 360. The tactile processing unit 350 may receive the location data from the sensor 310 and include a processor (e.g., DSP) for determining whether the vehicle has deviated from the predetermined path. Alternatively, the tactile processing unit 350 may receive the location data from the sensor 310 after the sensor 310 or other component (e.g., other processor) has determined that the vehicle has deviated from the predetermined path.

In response to a deviation, the tactile processing unit 350 may generate a tactile signal that is sent to the tactile actuator 360. The tactile signal may be an electrical signal that includes specific information about the type of deviation (e.g., location or severity of the deviation). Alternatively, the tactile signal may simply be a notification that a deviation has occurred without any specific information about the type of deviation.

The tactile actuator 360 may be an electromechanical device that converts the tactile signal into a mechanical movement, such as a vibration. In an exemplary embodiment, the tactile actuator 360 may simply cause the steering wheel or other part of the vehicle to vibrate in response to the vehicle's deviation. Depending on the amount of information provided within the tactile signal, a more advanced mechanical movement or vibration scheme may be employed to indicate to the user 308 the type, location, and/or severity of the deviation. For example, in an alternate embodiment, different portions of the steering wheel may vibrate depending on what portions of the vehicle have deviated from the predetermined path. Additionally, in such a scenario, the severity of the vibration may correspond to the severity of the deviation.

It should be understood that in alternate embodiments, the virtual rumble strip 300 may include more or fewer elements. For example, in an alternate embodiment, the virtual rumble strip 300 may omit the tactile processing unit 350 and/or the tactile actuator 360. Furthermore, the virtual rumble strip 300 may also include other mechanisms for warning the user 308 of a deviation, such as through other spatial audio alert mechanisms (e.g., using 2-dimensional audio alert (2-DAA) signals, changing the radio station that is playing, activating a cellular phone, etc.), visual alert mechanisms (e.g., flashing red light), or olfactory alert mechanisms (e.g., release of a burning smell). Additionally, the virtual rumble strip 300 may include a user-controllable switch that the user can activate to turn the virtual rumble strip on or off.

IV. Warning a User Using the Exemplary Virtual Rumble Strip

Figure 4:
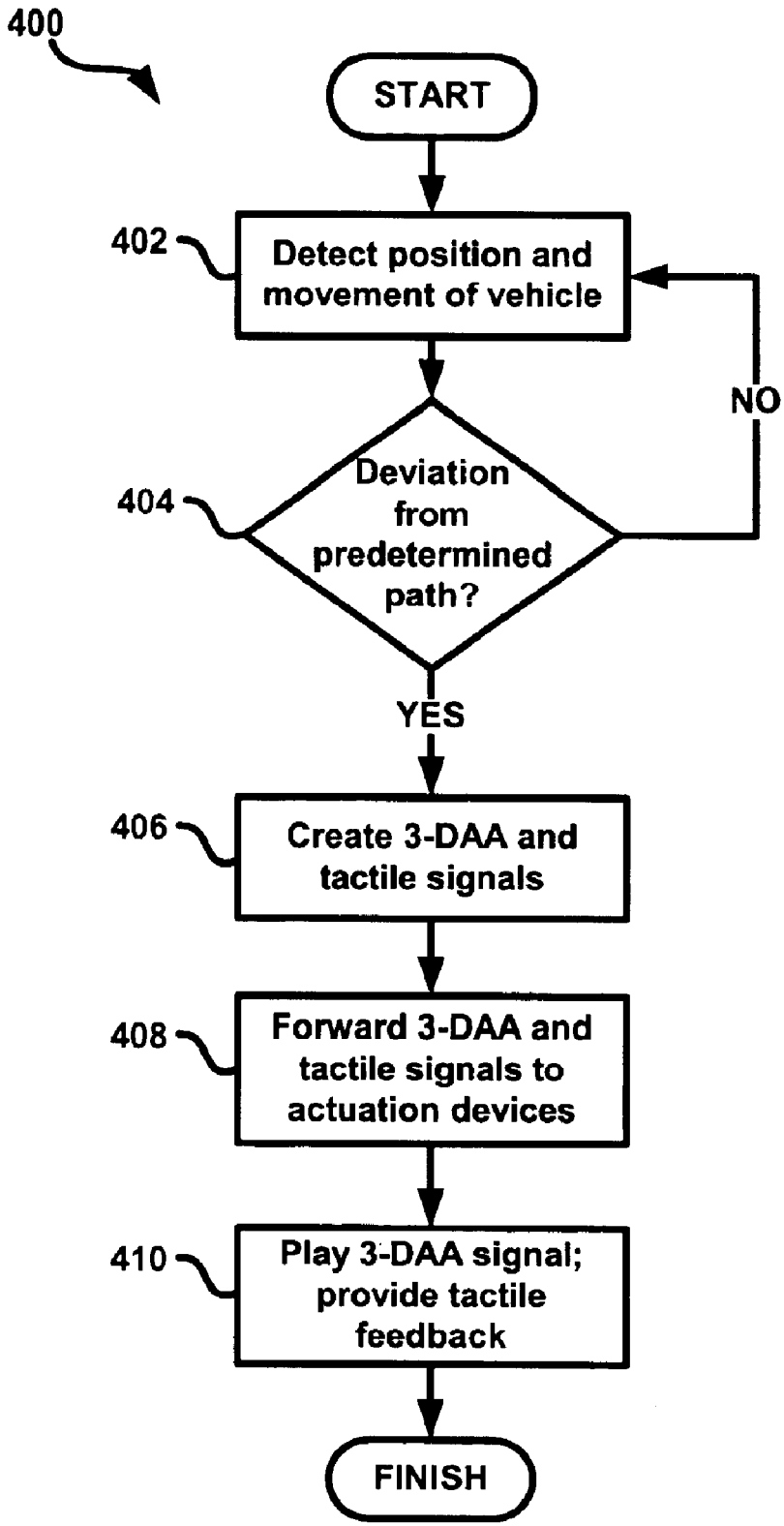
FIG. 4 is a flow chart illustrating an exemplary method of warning the users operating the vehicles of FIG. 1*a*–2*c* using the virtual rumble strip of FIG. 3.

Turning now to FIG. 4, an exemplary method 400 is shown for using the virtual rumble strip 300 to warn the user 308 that a vehicle that they are operating has deviated from a predetermined path. In step 402, the sensor 310 may determine location data for the vehicle by detecting the position and/or movement of the vehicle (e.g., automobile, airplane, boat) relative to the predetermined path (e.g., road, virtual tunnel, virtual waterway). As described previously, the sensor 310 may employ any number of different sensing mechanisms to detect the location data.

In step 404, the sensor 310 or other component within the virtual rumble strip 300 (e.g., audio processing unit 330, an additional processor, etc.) may use the location data to determine whether the vehicle has deviated from the predetermined path. If a deviation has not occurred, the method 400 may return to step 402 and the sensor 310 may continue monitoring the position and movement of the vehicle.

If a deviation has occurred, the method 400 may proceed to step 406, where the audio processing unit 330 and tactile processing unit 350 may process the location data to create a 3-DAA signal and a tactile signal, respectively. It should be understood that the creation of the 3-DAA signal and the tactile signal may occur either simultaneously or at different times, and that the sensor 310 may still monitor location data for the vehicle during this step. Furthermore, as described previously, the audio processing unit 330 may create the 3-DAA signal using an HRTF and the location data. The HRTF may be obtained by performing a Fourier transform (or computer-approximated Fourier transform) on an HRIF obtained during prior testing or mathematical modeling.

In step 408, actuation devices such as the speakers 340 and tactile actuator 360 may receive the 3-DAA signal and tactile signal, respectively, from the audio processing unit 330 and the tactile processing unit 350. In step 410, the speakers 340 may playback the 3-DAA signal to the user 308, who may interpret the 3-DAA signal as coming from the direction of the deviation of the vehicle. Thus, the user 308 may quickly realize the direction of the deviation and correct the motion of the automobile to help prevent an accident.

Additionally during step 410 (or at some other time), the tactile actuator 360 may create a vibration in the vehicle in response to the tactile signal. Thus, the tactile actuator 360 may also alert the user 308 of the deviation. In alternate embodiments, the tactile processing unit 350 and/or tactile actuator 360 may be omitted from the alerting mechanism 320, and tactile feedback (e.g., a vibration in the steering wheel) may not be provided to the user 308. Furthermore, different alert mechanisms (e.g., a flashing light, more complicated vibration patterns, etc.) may also be used during this step.

The virtual rumble strip presented in these exemplary embodiments may have numerous advantages. For example, the present virtual rumble strip may warn a user who has fallen asleep or lost alertness while operating a vehicle of a potential deviation in the vehicle's movement. In addition, such a virtual rumble strip may help a user navigate a vehicle along a predetermined path when inclement weather or other exterior conditions hinder visibility. Furthermore, the exemplary virtual rumble strip is not limited to use on land and may be used for any type of vehicle traveling on any type of medium (e.g., land, air, water, vacuum). Additionally, the present virtual rumble strip may enable a user to respond more quickly when the vehicle deviates from a predetermined path by providing the direction of the deviation within a spatial audio alert signal, thus reducing the chance of an accident.

It should be understood that a wide variety of additions and modifications may be made to the exemplary embodiments described within the present application. For example, the present virtual rumble strip 300 may be used for providing additional navigation information to users operating vehicles. To illustrate, in an exemplary embodiment, the virtual rumble strip 300 may be used to indicate to an automobile driver that certain landmarks are up ahead in the road (e.g., toll booth, stop sign, yield, etc.). In addition, certain components, functions, and operations of the virtual rumble strip 300 may be accomplished with hardware, software, and/or a combination of the two. It is therefore intended that the foregoing description illustrates rather than limits this invention and that it is the following claims, including all of the equivalents, which define this invention.

What is claimed is:

1. A virtual rumble strip for a user operating an aircraft, the virtual rumble strip comprising:

a location positioning system for detecting a deviation in movement of the aircraft from a predetermined virtual tunnel; and an alerting mechanism in communication with the location positioning system, wherein the alerting mechanism generates a 3-dimensional audio alert signal that warns the user of the deviation, and wherein the user may interpret the signal as originating from the direction of the deviation.

2. The virtual rumble strip of claim 1, wherein the alerting mechanism comprises a speaker for playing back the 3-dimensional audio alert signal to the user.

3. The virtual rumble strip of claim 2, wherein the speaker comprises a headphone.

4. The virtual rumble strip of claim 1, wherein the alerting mechanism comprises an audio processing unit.

5. The virtual rumble strip of claim 4, wherein the audio processing unit applies a Head-Related Transfer Function to the location data to create the 3-dimensional audio alert signal.

6. The virtual rumble strip of claim 5, wherein the Head-Related Transfer Function is customized for the user.

7. The virtual rumble strip of claim 5, wherein the Head Related Transfer Function is determined for an average user.

8. The virtual rumble strip of claim 5, wherein the audio processing unit creates the Head-Related Transfer Function by applying a Fourier transform to a Head-Related Impulse Response.

9. The virtual rumble strip of claim 8, wherein the Head-Related Impulse Response is determined by measuring an acoustic modification of an impulse by an ear.

10. The virtual rumble strip of claim 4, wherein the audio processing unit receives location data from a positioning system that tracks position in relation to a store database of terrain and man made features.

11. The virtual rumble strip of claim 1, wherein the location positioning system comprises a Global Positioning System.

12. The virtual rumble strip of claim 1, wherein the alerting mechanism comprises a tactile actuator for providing tactile feedback to the user in response to the deviation.

13. The virtual rumble strip of claim 1, further comprising a user-controllable switch for turning the virtual rumble strip on and off.

14. A method for warning a user operating an aircraft, the method comprising:

detecting location data for the aircraft;

determining a deviation in movement of the aircraft from a predetermined virtual tunnel using the location data;

creating a 3-dimensional audio alert signal based on the location data; and playing the 3-dimensional audio alert signal to warn the user of the deviation, wherein the user may interpret the signal as originating from the direction of the deviation.

15. The method of claim 14, wherein the location data comprises a position and movement of the aircraft relative to the predetermined virtual tunnel.

16. The method of claim 14, wherein detecting location data for the aircraft comprises using a location positioning system for detecting a position and movement of the aircraft relative to the predetermined virtual tunnel.

17. The method of claim 14, wherein creating a 3-dimensional audio alert signal comprises creating a 3-dimensional audio alert signal from the location data and a Head-Related Transfer Function.

18. The method of claim 17, further comprising performing a Fourier transform on a Head-Related Impulse Function to create the Head-Related Transfer Function.

19. The method of claim 14, further comprising creating tactile feedback for the user in response to the deviation.

20. A virtual rumble strip for an aircraft, the virtual rumble strip comprising:

a location positioning system that detects location data specifying a deviation in movement of the aircraft from a predetermined virtual tunnel;

an audio processing unit in communication with the location positioning system, wherein the audio processing unit creates a 3-dimensional audio alert signal that appears to originate from the direction of the deviation from a Head-Related Transfer Function and the location data; and a speaker for playing the 3-dimensional audio alert signal in the aircraft.

21. The virtual rumble strip of claim 20, wherein the audio processing unit creates the Head-Related Transfer Function by applying a Fourier transform to a Head-Related Impulse Response.

22. The virtual rumble strip of claim 20, wherein the location positioning system is a Global Positioning System.

23. The virtual rumble strip of 20, wherein the alerting mechanism comprises a tactile processing unit for creating a tactile signal in response to the deviation.

24. The virtual rumble strip of claim 23, wherein the alerting mechanism comprises a tactile actuator that receives the tactile signal from the tactile processing unit and provides tactile feedback to a user operating the aircraft.

25. The virtual rumble strip of claim 20, further comprising at least one of a visual alert mechanism and an olfactory alert mechanism for warning a user operating the aircraft of the deviation.

26. The virtual rumble strip of claim 1 wherein the aircraft is an airplane, a helicopter, a space shuttle, a dirigible, or a hovercraft.

27. The virtual rumble strip of claim 20, wherein the aircraft is an airplane, a helicopter, a space shuttle, a dirigible, or a hovercraft.

* * * * *